US010309288B2

(12) United States Patent
Endo et al.

(10) Patent No.: US 10,309,288 B2
(45) Date of Patent: Jun. 4, 2019

(54) WATER INGRESS PREVENTING STRUCTURE FOR TAILPIPE

(71) Applicant: HINO MOTORS, LTD., Hino-shi (JP)

(72) Inventors: Hiroshi Endo, Tokyo (JP); Hiroshi Tsukisaka, Tokyo (JP)

(73) Assignee: HINO MOTORS, LTD., Hino-shi (JP)

( * ) Notice: Subject to any disclaimer, the term of this patent is extended or adjusted under 35 U.S.C. 154(b) by 104 days.

(21) Appl. No.: 15/521,024

(22) PCT Filed: Jan. 22, 2016

(86) PCT No.: PCT/JP2016/051873
§ 371 (c)(1),
(2) Date: Apr. 21, 2017

(87) PCT Pub. No.: WO2016/121649
PCT Pub. Date: Aug. 4, 2016

(65) Prior Publication Data

US 2017/0370270 A1 Dec. 28, 2017

(30) Foreign Application Priority Data

Jan. 26, 2015 (JP) ..... 2015-012107
Jan. 28, 2015 (JP) ..... 2015-013823

(51) Int. Cl.
*F01N 13/08* (2010.01)
*F01N 13/20* (2010.01)
*F01N 13/00* (2010.01)

(52) U.S. Cl.
CPC ..... *F01N 13/082* (2013.01); *F01N 13/008* (2013.01); *F01N 13/085* (2013.01);
(Continued)

(58) Field of Classification Search
CPC ..... F01N 1/14; F01N 3/005; F01N 13/004; F01N 13/085; F01N 13/20;
(Continued)

(56) References Cited

U.S. PATENT DOCUMENTS 4,735,046 A * 4/1988 Iwai ..... F01M 11/10 60/295
6,012,285 A 1/2000 Lutz et al.
(Continued)

FOREIGN PATENT DOCUMENTS

DE 10 2014 103 602 A1 9/2015
FR 1238805 A * 8/1960 ..... F01N 1/10
(Continued)

OTHER PUBLICATIONS

Extended European Search Report dated Jun. 8, 2018 in Patent Application No. 16743252.5.
(Continued)

*Primary Examiner* — Jonathan R Matthias
(74) *Attorney, Agent, or Firm* — Oblon, McClelland, Maier & Neustadt, L.L.P.

(57) ABSTRACT

Disclosed is a water ingress preventive structure for a tailpipe which discharges exhaust gas outside of a vehicle at a terminal of an exhaust passage system. A curved shape is imparted to the tailpipe. A partition is mounted on an inner periphery of a curved portion outward of a curved direction so as to be gradually spaced apart from the inner periphery toward downstream in a direction of flow of the exhaust gas. Thus, a dead end portion is defined by the partition and the inner periphery of the curved portion outward of the curved direction.

8 Claims, 6 Drawing Sheets

(52) U.S. Cl.
CPC ..... *F01N 13/20* (2013.01); *F01N 2260/26* (2013.01); *F01N 2270/08* (2013.01); *F01N 2470/04* (2013.01); *F01N 2470/20* (2013.01); *F01N 2470/30* (2013.01); *F01N 2560/05* (2013.01)

(58) Field of Classification Search
CPC ..... F01N 2260/26; F01N 2270/02; F01N 2270/08; F01N 2270/10; F01N 2470/30
See application file for complete search history.

(56) References Cited

U.S. PATENT DOCUMENTS 6,478,645 B1 * 11/2002 Allbright ..... B63H 21/32 440/89 R
2010/0058749 A1 * 3/2010 Salamat ..... F01N 13/082 60/311
2011/0011060 A1 * 1/2011 McCarthy, Jr. ..... F01N 3/0814 60/274

FOREIGN PATENT DOCUMENTS

| | | | |
|---|---|---|---|
| JP | 56-169410 | U | 12/1981 |
| JP | 6-73324 | U | 10/1994 |
| JP | 2003-314276 | A | 11/2003 |
| JP | 2004-60511 | A | 2/2004 |
| JP | 2009-121310 | A | 6/2009 |
| KR | 10-2012-0137150 | A | 12/2012 |
| KR | 10-2012-0137155 | A | 12/2012 |

OTHER PUBLICATIONS

International Search Report dated Apr. 19, 2016 in PCT/JP2016/051873 filed Jan. 22, 2016.

* cited by examiner

WATER INGRESS PREVENTING STRUCTURE FOR TAILPIPE

TECHNICAL FIELD

The present invention relates to a water ingress preventive structure for a tailpipe.

BACKGROUND ART

Nowadays a particulate filter for capture of particulates in exhaust gas is incorporated in an exhaust pipe, and a selective reduction catalyst capable of selectively reacting $NO_x$ with ammonia even in the presence of oxygen is arranged downstream of the particulate filter, urea water as reducing agent being added at a position between the selective reduction catalyst and the particulate filter to thereby concurrently reduce the particulates and $NO_x$.

In such case, the addition of the urea water to the selective reduction catalyst is at between the particulate filter and the selective reduction catalyst. In order to ensure ample reaction time for pyrolysis of the urea water added to the exhaust gas into ammonia and carbon dioxide gas, required is elongation of a distance between the urea water added position and the selective reduction catalyst. However, to arrange the particulate filter and the selective reduction catalyst in a sufficient spaced-apart relationship will extremely impair mountability on a vehicle.

Thus, the applicant of the invention devises a compact-sized exhaust emission control device with a particulate filter and a selective reduction catalyst arranged in parallel with each other. A discharge end of the particulate filter is connected to an entry end of the selective reduction catalyst through an S-shaped communication passage so as to make the exhaust gas from the discharge end of the particulate filter reversely turn around into the entry end of the adjacent selective reduction catalyst.

In such exhaust emission control device, the particulate filter and the selective reduction catalyst are encased by a casing which serves also as muffler. The selective reduction catalyst arranged downstream of the particulate filter has a discharge end with a tailpipe for discharge of the depurated exhaust gas outside of a vehicle.

Meanwhile, recently obliged in countries is equipment of an onboard diagnosis device (OBD) which monitors any failure in an exhaust gas emission control device and, upon failure occurrence, turns on a warning light or the like for announcement of the failure occurrence to a driver and records details of the failure. As shown in FIGS. 1-3, mounted at a deep position of this kind of tailpipe 1 is a sensor 2 for concentration-detection of particulates or particulate matter (PM) to ascertain whether the particulates are properly reduced or not.

There exists, for example, below-mentioned Patent Literature 1 showing state-of-art technology pertinent to this kind of tailpipe.

CITATION LIST

Patent Literature

Patent Literature 1: JP 2009-121310 A

SUMMARY OF INVENTION

Technical Problems

However, known is a fact that the sensor 2 for concentration-detection of the particulates or particulate matter (PM) as mentioned in the above, which is an extremely fragile precision device, may be damaged just by splash due to ingress of washing water into the tailpipe 1 upon high-pressure washing of a vehicle body. Especially, the sensor 2 remaining hot just after stop of an engine may be easily damaged due to drastic thermal contradiction when splashed with cold water.

A curved shape has been employed for existing typical tailpipes 1 to prevent direct water hammer from affecting deep into the tailpipe when high-pressure washing water is sprayed from outside of the vehicle toward an outlet 4 from which exhaust gas 3 is discharged. However, it remains a fear that vigorous ingress of the washing water into the tailpipe 1 may cause the washing water to flow curvedly and reach deep along a curved portion 1*a* of the tailpipe 1, resulting in the sensor 2 being splashed with the washing water.

Also proposed is protection of the sensor 2 from splash by overlaying a punched porous splash-preventive cover on a sensing element of the sensor 2. However, in such case, it is feared that responsiveness in detection by the sensor 2 may be disturbed by the splash-preventive cover.

The invention was made in view of the above and has its object to provide a water ingress preventive structure for a tailpipe which can reliably prevent ingress of washing water into a deep position of the tailpipe upon high-pressure washing of a vehicle body.

Solution to Problems

The invention is directed to a water ingress preventive structure for a tailpipe for discharge of exhaust gas outside of a vehicle at a terminal of an exhaust passage system, a curved shape being imparted to said tailpipe, characterized by comprising a partition mounted on an inner periphery of a curved portion, outward of a curved direction, of said tailpipe so as to be gradually spaced apart from said inner periphery toward downstream in a direction of flow of the exhaust gas, whereby a dead end portion is defined by said partition and said inner periphery of the curved portion outward of the curved direction.

When washing water is sprayed toward an outlet of the tailpipe upon high-pressure washing of a vehicle body, owing to the above structure, the washing water linearly ingressed into the outlet flows along the inner periphery of the curved portion, outward of the curved direction, of the tailpipe and impinges on and is dammed by the dead end portion defined by the partition. Splash upon the impingement is rebounded by the partition overlying. Thus, the ingress of the washing water into a deep position of the tailpipe upon the high-pressure washing of the vehicle body can be prevented.

Since the partition in the tailpipe is arranged on the inner periphery of the curved portion outward of the curved direction in the gradually spaced-part relationship therefrom toward downstream in the direction of flow of the exhaust gas, the flow of the exhaust gas can be smoothly guided without hardship in the curved direction of the curved portion, thereby preliminarily preventing excessive pressure loss in the flow of the exhaust gas.

Preferably, the curved portion is distended outward of the curved direction such that, in a condition without the partition, a flow passage cross-sectional area at a defined position of the dead end portion is larger than that upstream of the curved portion. This causes no excessive decrease in the flow passage cross-sectional area of the tailpipe by the addition of the partition and can ensure the dead end portion large in size for damming the ingress of the washing water.

Further, it is preferable to ensure that the flow passage cross-sectional area decreased by the partition is larger than an opening cross-sectional area of the outlet of the tailpipe, which can substantially suppress pressure loss in the flow of the exhaust gas by the addition of the partition.

In a further aspect, the invention is directed to a water ingress preventive structure for a tailpipe for discharge of exhaust gas outside of a vehicle at a terminal of an exhaust passage system, a curved shape being imparted to the tailpipe, characterized by comprising a drainage opening on a curved portion of the tailpipe at a position outward of a curved direction and opposite to an outlet of said tailpipe and a cover for covering, in a spaced-apart relationship, an outer periphery of said curved portion outward of the curved direction so as not to block said drainage opening, said cover extending upstream in a scroll shape from a downstream end of said drainage opening to open a drainage port upstream of said drainage opening.

When washing water is sprayed toward the outlet of the tailpipe upon high-pressure washing of the vehicle body, owing to the above structure, the washing water linearly ingressed into the outlet passes through the drainage opening to an inner periphery of the cover, flows along the inner periphery of the cover and between the same and an outer periphery of the tailpipe and is discharged outside of the tailpipe through the drainage port far away from the outlet. Thus, ingress of the washing water into a deep position of the tailpipe upon high-pressure washing of the vehicle body can be prevented.

Since the cover extends upstream in the scroll shape from the downstream end of the drainage opening, the washing water linearly ingressed through the outlet of the tailpipe smoothly flows along the inner periphery of the tailpipe outward of the curved direction as well as the inner periphery of the cover, which are continuous surfaces without steps, and readily reach and is discharged through the drainage port without greatly losing power, thereby preliminarily preventing a situation that great splash is caused by violent impingement of the washing water against wall surfaces.

The drainage opening on the tailpipe is covered with the cover to prevent ingress of the washing water and the splash; the drainage port defined by the cover is opened at a position substantially spaced apart upstream from the outlet of the tailpipe. Thus, even in the situation of the ingress of the washing water into the outlet of the tailpipe upon the high-pressure washing, the ingress to the drainage port is hard to occur; even if the ingress of the washing water into the drainage port is caused, there is no fear that the washing water then flows round toward upstream again through the downstream drainage opening.

The curved shape is preferably vertically imparted to the tailpipe such that the flow of the exhaust gas from upward to downward is curved into a horizontal direction and is directed to the outlet, so that the washing water remaining in the cover at an end of the high-pressure washing flows down due to gravity and is certainly discharged through the outlet.

Further, it is preferable that the flow passage cross-sectional area of the curved portion is gradually reduced toward the outlet of the tailpipe such that ambient air can be taken into the tailpipe through the drainage port due to an effect of reduced pressure resulting from increase in flow rate of the exhaust gas to the outlet, so that the ambient air is taken through the drainage port as the exhaust gas flows through the tailpipe; such admixing of the ambient air lowers temperature of the exhaust gas.

Advantageous Effects of Invention

The above-mentioned water ingress preventive structure for the tailpipe of the invention can exhibit various excellent effects since ingress of washing water to a deep position of the tailpipe can be prevented upon high-pressure washing of the vehicle body. For example, a sensor, when arranged upstream of the curved portion of the tailpipe, can be protected from the washing water. Responsiveness in detection by the sensor can be kept high without covering a sensing element of the sensor with a splash-preventive cover.

DESCRIPTION OF EMBODIMENTS

Embodiments of the invention will be described in conjunction with the drawings.

Figure 1:
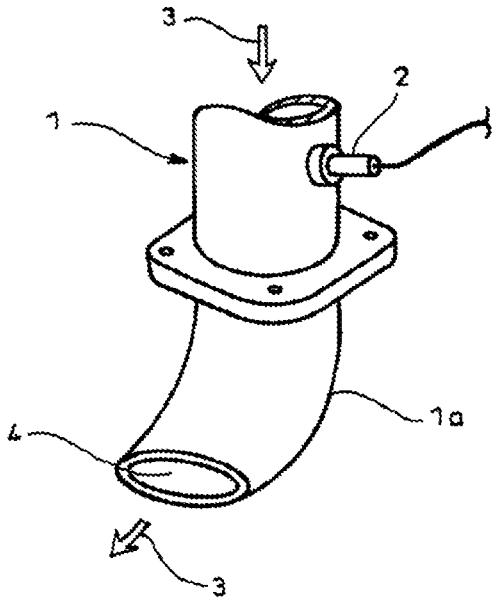
FIG. 1 is a perspective view showing a conventional example.
Figure 2:
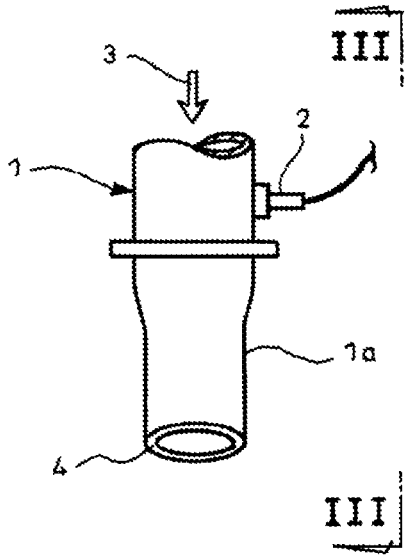
FIG. 2 is a front view of the tailpipe shown in FIG. 1.
Figure 3:
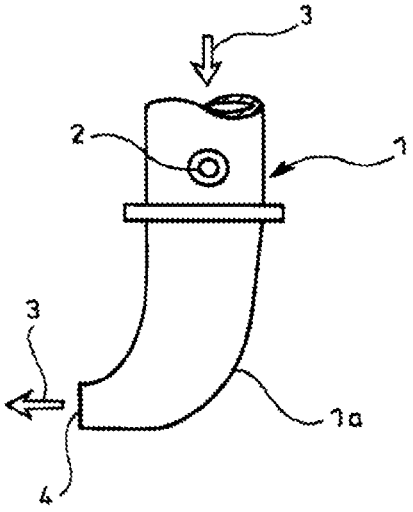
FIG. 3 is a view looking in a direction of arrows III in FIG. 2.
Figure 4:
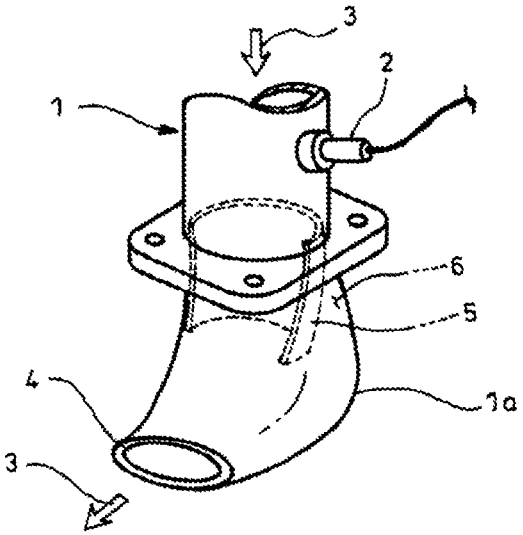
FIG. 4 is a perspective view showing an embodiment of the invention.
Figure 5:
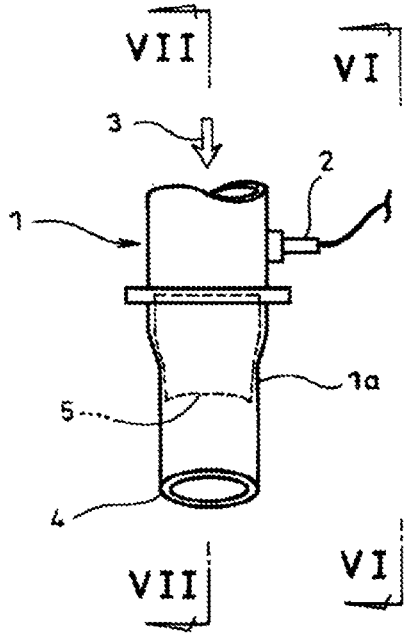
FIG. 5 is a front view of the tailpipe shown in FIG. 4.

FIGS. 4-7 show an embodiment of the invention in which parts same as those in FIGS. 1-3 are represented by same reference numerals. In the embodiment illustrated, a curved shape is employed just like the conventional example shown in FIGS. 1-3 such that direct water hammer does not affect deep upon high-pressure washing of a vehicle body. A partition 5 is mounted on an inner periphery of a curved portion 1*a* outward of a curved direction such that the partition 5 is gradually spaced apart from the inner periphery toward downstream in a direction of flow of exhaust gas 3 to thereby define a dead end portion 6 between the partition 5 and the inner periphery of the curved portion 1*a* outward of the curved direction.

In this case, the curved portion 1*a* is distended outward of the curved direction such that, in a condition without the partition 5, a flow passage cross-sectional area at a defined position of the dead end portion 6 is larger than that upstream of the curved portion 1*a*. Especially in the embodiment, the partition 5 is provided in a position relationship as if it were along a contour of the curved portion 1*a* of the conventional tailpipe 1 (see FIGS. 1-3) outward of the curved direction to thereby define the dead end portion 6 by the distended portion outward of the curved direction of the partition 5.

It is ensured that the flow passage cross-sectional area decreased by the partition 5 is larger than the opening cross-sectional area of the outlet 4 of the tailpipe 1. Thus, in the embodiment, with the partition 5 being added, ensured is a flow passage space substantially similar to that in the conventional example shown in FIGS. 1-3.

Arranged at a deep position upstream of the curved portion 1*a* of the tailpipe 1 is a sensor 2 for concentration-detection of particulates or particulate matter (PM) which can ascertain whether the particulates is properly reduced or not by a particulate filter (not shown) arranged further upstream.

Figure 6:
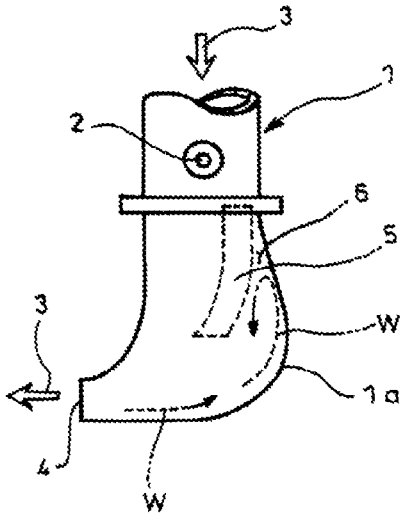
FIG. 6 is a view looking in a direction of arrows VI in FIG. 5.
Figure 7:
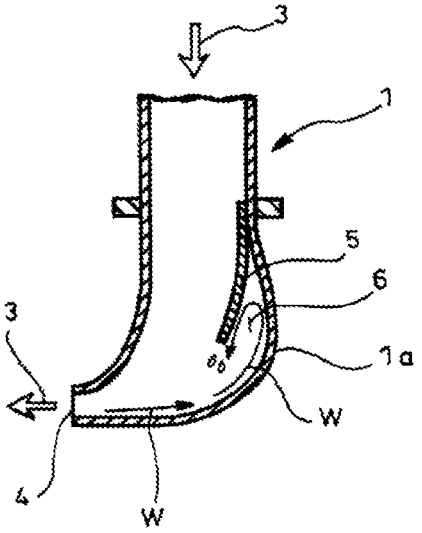
FIG. 7 is a sectional view in a direction of arrows VII in FIG. 5.
Figure 8:
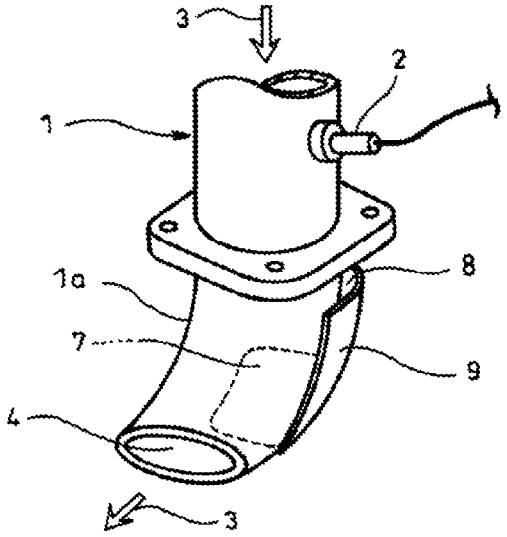
FIG. 8 is a perspective view showing a further embodiment of the invention.
Figure 9:
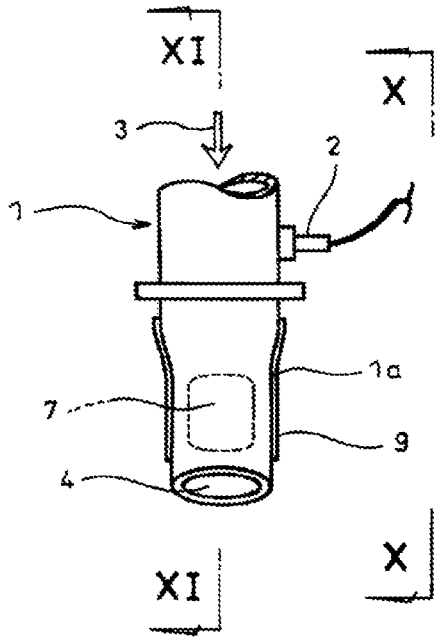
FIG. 9 is a front view of the tailpipe shown in FIG. 8.

Even if the washing water is sprayed toward the outlet 4 of the tailpipe 1 as shown by arrows W in FIGS. 6 and 7 upon high-pressure washing of the vehicle body, owing to the structure, the washing water linearly ingressed through the outlet 4 flows along the inner periphery of the curved portion 1*a*, outward of the curved direction, of the tailpipe 1 and impinges on and is dammed by the dead end portion 6 defined by the partition 5. Any splash upon the impingement is rebounded by the partition 5 overlying. Thus, the ingress of the washing water into a deep position in the tailpipe 1 upon high-pressure washing of the vehicle body can be prevented.

The partition 5 in the tailpipe 1 is arranged to be gradually spaced apart from the inner periphery of the curved portion 1*a* outward of the curved direction toward downstream in the direction of flow of the exhaust gas 3 so that the flow of the exhaust gas 3 can be smoothly guided without hardship in the curved direction of the curved portion 1*a*, thereby preliminarily preventing excessive pressure loss in the flow of the exhaust gas 3.

Especially, in the embodiment, the curved portion 1*a* is distended outward of the curved direction such that, in the condition without the partition 5, the flow passage cross-sectional area at the defined position of the dead end portion 6 is greater than that upstream of the curved portion 1*a*. This causes no excessive decrease in the flow passage cross-sectional area of the tailpipe 1 by the addition of the partition 5 and can ensure the dead end portion 6 large in size for damming the ingress of the washing water. Moreover, it is ensured that the flow passage cross-sectional area decreased by the partition 5 is larger than an opening cross-sectional area of the outlet 4 of the tailpipe 1, which can substantially suppress pressure loss in the flow of the exhaust gas 3 by the addition of the partition 5.

Thus, the above embodiment can prevent the ingress of the washing water to the deep position in the tailpipe 1 upon high-pressure washing of the vehicle body, so that the sensor 2, when arranged upstream of the curved portion 1*a* of the tailpipe 1, can be protected from the washing water. Moreover, responsiveness in detection by the sensor 2 can be kept high since there is no need of a sensing element of the sensor 2 being covered with a splash-preventive cover.

The fact that the curved portion 1*a* is distended outward of the curved direction such that, in the condition without the partition 5, the flow passage cross-sectional area at the defined position of the dead end portion 6 is greater than that upstream of the curved portion 1*a* can preliminarily prevent substantial increase in pressure loss due to excessive decrease of the flow passage cross-sectional area of the tailpipe 1 by the addition of the partition 5 and can increase in size the dead end portion 6 to dam more reliably the ingress of the washing water.

The fact that the flow passage cross-sectional area decreased by the partition 5 is ensured to be greater than the opening cross-sectional area of the outlet 4 of the tailpipe 1 can substantially suppress pressure loss in the flow of the exhaust gas 3 by the addition of the partition 5 to maintain exhaust performance as usual despite of the addition of the partition 5.

FIGS. 8-11 shows a further embodiment of the invention. In the embodiment illustrated, just like the conventional example shown in FIGS. 1-3, a curved shape is employed such that direct water hammer does not affect deep upon high-pressure washing of a vehicle body. A drainage opening 7 is opened at a position of a curved portion 1*a* outward of a curved direction and opposite to an outlet 4 of a tailpipe 1. A cover 9 is arranged to cover, in a spaced apart relationship, an outer periphery of the curved portion 1*a* outward of the curved direction so as not to block the drainage opening 7 and extends upstream in a scroll shape from a downstream end of the drainage opening 7 to provide a drainage port 8 upstream of the drainage opening 7.

Especially, in the embodiment, the curved shape is vertically imparted to the tailpipe 1 such that the flow of exhaust gas 3 from upward to downward is curved into a horizontal direction and is directed to the outlet 4. The curved portion 1*a* is flattened toward the outlet 4 of the tailpipe 1 to gradually decrease the flow passage cross-sectional area, whereby the ambient air can be taken through the drainage port 8 due to an effect of reduced pressure resulting from increase in flow rate of the exhaust gas 3 to the outlet 4.

Arranged at a deep position of the tailpipe 1 upstream of the curved portion 1*a* is a sensor 2 for concentration-detection of particulates or particulate matter (PM). Arranged further upstream is a particulate filter (not shown) which ascertains whether the particulates are properly reduced or not.

Figure 10:
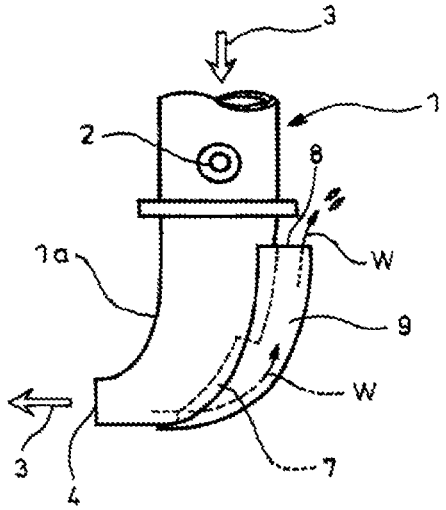
FIG. 10 is a view looking in direction of arrows X in FIG. 9.
Figure 11:
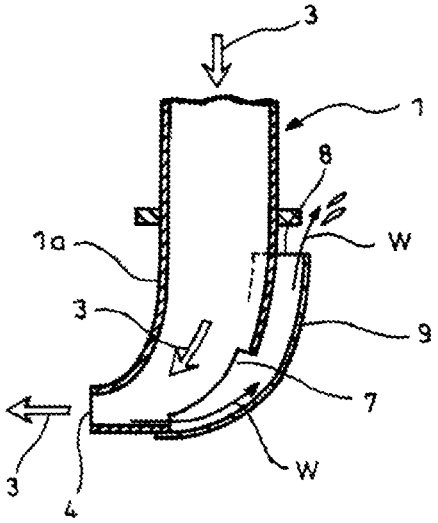
FIG. 11 is a sectional view in a direction of arrows XI in FIG. 9.

Then, even if the washing water is sprayed to the outlet 4 of the tailpipe 1 as shown by arrows W in FIGS. 10 and 11 upon high-pressure washing of the vehicle body, owing to the structure, the washing water linearly ingressed through the outlet 4 passes through the drainage opening 7 to the inner periphery of the cover 9, flows along the inner periphery of the cover 9 between the same and the outer periphery of the tailpipe 1 and is discharged outside of the tailpipe 1 through the drainage port 8 substantially away from the outlet 4, which prevents ingress of the washing water to a deep position in the tailpipe 1 upon high-pressure washing of the vehicle body.

In this case, since the cover 9 extends upstream in the scroll shape from the downstream end of the drainage opening 7, the washing water linearly ingressed through the outlet 4 of the tailpipe 1 smoothly flows along the inner periphery of the tailpipe 1 outward of the curved direction as well as the inner periphery of the cover 9, which are continuous surfaces without steps, and readily reaches and is discharged through the drainage port 8 without greatly losing power, thereby preliminarily preventing a situation that great splash is caused by violent impingement of the washing water against wall surfaces.

The drainage opening 7 of the tailpipe 1 is covered with the cover 9 to prevent ingress of the washing water and the splash and the drainage port 8 defined by the cover 9 is opened at the position substantially spaced apart upstream from the outlet 4 of the tailpipe 1. Thus, even in the situation of the ingress of the washing water into the outlet 4 of the tailpipe 1 upon the high-pressure washing, the ingress to the drainage port 8 is hard to occur; even if the ingress of the washing water into the drainage port 8 is caused, there is no fear that the washing water then flows round toward upstream again through the downstream drainage opening 7.

Especially, in the embodiment, the curved shape is vertically imparted to the tailpipe 1 such that the flow of the exhaust gas 3 from upward to downward is curved into the horizontal direction and is directed to the outlet 4, so that the washing water remaining in the cover 9 at the end of the high-pressure washing flows down due to gravity and is certainly discharged through the outlet 4.

Moreover, the flow passage cross-sectional area of the curved portion is gradually reduced toward the outlet 4 of the tailpipe 1 such that the ambient air can be taken into the tailpipe 1 through the drainage port 8 due to the effect of reduced pressure resulting from the increase in flow rate of the exhaust gas 3 to the outlet 4, so that the ambient air is taken through the drainage port 8 as the exhaust gas 3 flows through the tailpipe 1; such admixing of the ambient air lowers a temperature of the exhaust gas 3.

Thus, according to the above-mentioned embodiment, the ingress of the washing water to a deep position of the tailpipe 1 upon high-pressure washing of vehicle body can be prevented so that the sensor 2, when arranged upstream of the curved portion 1*a* of the tailpipe 1, can be protected from the washing water. Moreover, there is no need of a sensing element of the sensor 2 being covered with a splash-preventive cover, which can maintains high responsiveness in detection by the sensor 2.

At an end of the high-pressure washing, the washing water remaining in the cover 9 flows down due to gravity and can be reliably discharged through the outlet 4 of the tailpipe 1 so that production of rust and the like due to remaining of the washing water in the tailpipe 1 can be preliminarily prevented. Moreover, the ambient air can be taken through the drainage port 8 into mixing with the exhaust gas 3 as the exhaust gas 3 flows through the tailpipe 1, thereby decreasing the temperature of the exhaust gas 3. This can enhance safeness against, for example, pedestrians passing by the outlet 4 of the tailpipe 1 during stop of the vehicle.

It is to be understood that the water ingress prevention structure for the tailpipe according to the invention is not limited to the above embodiments and that various changes and modifications may be made without departing from the scope of the invention. For example, the exhaust emission control device upstream of the tailpipe is not restricted to that with the particulate filter and the selective reduction catalyst arranged in parallel with each other. The sensor on the tailpipe is not restricted to the sensor for the particulates or particulate matter (PM).

REFERENCE SIGNS LIST

1 tailpipe
1*a* curved portion
3 exhaust gas
4 outlet
5 partition
6 dead end portion
7 drainage opening
8 drainage port
9 cover

The invention claimed is:

1. A tailpipe for discharge of exhaust gas outside of a vehicle at a terminal of an exhaust passage system, the tailpipe including a water ingress preventive structure, and a curved shape being imparted to said tailpipe, the tailpipe comprising:

a partition mounted on an inner periphery of a curved portion, outward of a curved direction, of said tailpipe so as to be gradually spaced apart from said inner periphery toward downstream in a flow direction of the exhaust gas, wherein a dead end portion is defined by said partition and said inner periphery of the curved portion outward of the curved direction, wherein the curved shape is vertically imparted to the tailpipe such that a flow of the exhaust gas from upward to downward is curved into a horizontal direction and is directed to an outlet of the tailpipe, and wherein a particulate sensor is disposed upstream of the partition in the flow direction of the exhaust gas.

2. The tailpipe as claimed in claim 1, wherein said curved portion is distended outward of the curved direction such that, in a condition without the partition, a flow passage cross-sectional area at a defined position of the dead end portion is larger than that upstream of the curved portion.

3. The tailpipe as claimed in claim 2, wherein the flow passage cross-sectional area decreased by the partition is larger than an opening cross-sectional area of an outlet of the tailpipe.

4. The tailpipe as claimed in claim 1, wherein the flow passage cross-sectional area decreased by the partition is larger than an opening cross-sectional area of an outlet of the tailpipe.

5. The tailpipe according to claim 1, wherein an upper end of the partition abuts an inner portion of the tailpipe upstream of the curved portion in the flow direction of the exhaust gas, and a lower end of the partition is aligned with the curved portion in the flow direction of the exhaust gas.

6. A tailpipe for discharge of exhaust gas outside of a vehicle at a terminal of an exhaust passage system, the tailpipe including a water ingress preventive structure, and a curved shape being imparted to the tailpipe, the tailpipe comprising:

a drainage opening on a curved portion of the tailpipe at a position outward of a curved direction and opposite to an outlet of said tailpipe; and a cover for covering, in a spaced-apart relationship, an outer periphery of said curved portion outward of the curved direction so as not to block said drainage opening, said cover extending upstream in a scroll shape from a downstream end of said drainage opening to open a drainage port upstream of said drainage opening, wherein the curved shape is vertically imparted to the tailpipe such that the flow of the exhaust gas from upward to downward is curved into a horizontal direction and is directed to the outlet, and wherein a particulate sensor is disposed upstream of the drainage opening in a flow direction of the exhaust gas.

7. The tailpipe as claimed in claim 6, wherein the flow passage cross-sectional area of the curved portion is gradually reduced toward the outlet of the tailpipe such that ambient air can be taken into the tailpipe through the drainage port due to an effect of reduced pressure resulting from increase in flow rate of the exhaust gas directed to said outlet.

8. The tailpipe as claimed in claim 6, wherein the flow passage cross-sectional area of the curved portion is gradually reduced toward the outlet of the tailpipe such that ambient air can be taken into the tailpipe through the drainage port due to an effect of reduced pressure resulting from increase in flow rate of the exhaust gas directed to said outlet.

* * * * *